US009725197B2

(12) United States Patent
Pettersson et al.

(10) Patent No.: US 9,725,197 B2
(45) Date of Patent: Aug. 8, 2017

(54) ERECTING AID

(75) Inventors: Niklas Pettersson, Sandy, UT (US); Ryan Osterhout, West Haven, UT (US)

(73) Assignee: Packsize LLC, Salt Lake City, UT (US)

( * ) Notice: Subject to any disclaimer, the term of this patent is extended or adjusted under 35 U.S.C. 154(b) by 612 days.

(21) Appl. No.: 13/264,358

(22) PCT Filed: Apr. 14, 2010

(86) PCT No.: PCT/US2010/031017

§ 371 (c)(1),
(2), (4) Date: Dec. 20, 2011

(87) PCT Pub. No.: WO2010/120869

PCT Pub. Date: Oct. 21, 2010

(65) Prior Publication Data

US 2012/0131888 A1 May 31, 2012

Related U.S. Application Data

(60) Provisional application No. 61/169,638, filed on Apr. 15, 2009.

(51) Int. Cl.
*B65B 43/00* (2006.01)
*B65B 43/26* (2006.01)
(Continued)

(52) U.S. Cl.
CPC ..... *B65B 43/265* (2013.01); *B65B 5/026* (2013.01); *B65B 43/39* (2013.01); *B31B 2203/084* (2013.01)

(58) Field of Classification Search
CPC .... B31B 1/14; B31B 1/16; B31B 3/26; B31B 3/44; B31B 1/52; B31B 5/26
(Continued)

(56) References Cited

U.S. PATENT DOCUMENTS 3,125,840 A * 3/1964 Cross ..... B65B 5/024 53/157
3,832,826 A 9/1974 Ullman
(Continued)

FOREIGN PATENT DOCUMENTS

CN 1409676 4/2003
CN 101096226 1/2008
(Continued)

OTHER PUBLICATIONS

International Search Report and Written Opinion for PCT/US2010/031017 mailed Jun. 28, 2010.
European Search Report for EP10765078 dated Apr. 22, 2015.

*Primary Examiner* — Andrew M Tecco
*Assistant Examiner* — Chelsea Stinson
(74) *Attorney, Agent, or Firm* — Workman Nydegger

(57) ABSTRACT

An erecting aid for packaging materials is described and may include a table portion and a panel. A panel may be coupled to one side of the table portion. The table portion and the panel can be configured such that the table portion and panel form an acute angle and the panel acts as a type of back support wall with respect to the table portion. A clamp may cooperate with the table portion to produce a clamping force. The clamping force may occur by biasing at least a portion of the clamp towards a relaxed, closed. The combination of the table, panel and biased clamp provide the forces necessary to stabilize a partially folded corrugated box during the erecting process such that the partially folded corrugated box is stabilized and maintained in a partially assembled state while the operator can use both hands to complete the erecting process.

23 Claims, 9 Drawing Sheets

(51) Int. Cl.
*B65B 43/39* (2006.01)
*B65B 5/02* (2006.01)

(58) Field of Classification Search
USPC ..... 493/35–397, 405, 412, 421, 422, 451
See application file for complete search history.

(56) References Cited

U.S. PATENT DOCUMENTS

| | | | | |
|---|---|---|---|---|
| 4,210,069 | A * | 7/1980 | Meyers | B31B 1/06 493/313 |
| 4,215,522 | A | 8/1980 | Clift et al. | |
| 4,275,543 | A * | 6/1981 | Marchetti | 53/376.8 |
| 4,342,563 | A * | 8/1982 | Campbell | B31B 1/52 493/168 |
| 5,971,906 | A * | 10/1999 | Tharpe et al. | 493/131 |
| 5,980,440 | A * | 11/1999 | Mitman et al. | 493/52 |
| 6,185,912 | B1 * | 2/2001 | Artois et al. | 53/456 |
| 2007/0199648 | A1 | 8/2007 | Hulverscheidt | |

FOREIGN PATENT DOCUMENTS

| | | |
|---|---|---|
| DE | 19636262 | 3/1998 |
| FR | 2554417 | 5/1985 |
| WO | 97/15495 | 5/1997 |
| WO | 2010120869 | 10/2010 |

* cited by examiner

ERECTING AID

CROSS-REFERENCE TO RELATED APPLICATIONS

This application claims the benefit of, and priority to, U.S. Provisional Patent Application Ser. No. 61/169,638, filed on Apr. 15, 2009, and entitled "ERECTING AID," which application is expressly incorporated herein by this reference in its entirety.

BACKGROUND OF THE INVENTION

1. The Field of the Invention

Example embodiments of the present invention relate to methods, apparatus, and assemblies for erecting and assembling packaging. More particularly, example embodiments of the invention relate to an erecting aid that assists a user in erecting boxes made from corrugated board.

2. The Related Technology

For decades now, the shipping and other industries have commonly made use of corrugated board boxes. In general, the manufacture of a corrugated board box is performed by using an automated machine known as a converter to produce a box template. This type of a machine may perform a number of different functions on raw corrugated board to produce a corrugated board box template. Example machines, may, for example, take raw corrugated board from a roll or fanfold stack, and crease, cut, fold, perforate, score, or otherwise manipulate the raw corrugated board to produce a desired shape and design.

The shape, size, and design of the template may vary based on any of a number of different considerations. For instance, the dimensions of an item or product to be contained in the box may form the basis of particular dimensions of the box. Depending on other factors—such as the desired design, ease of assembly, protective characteristics of the box—an infinite number of possible template configurations are available.

Notwithstanding the infinite variety available for boxes and other packaging, many box templates have been standardized. Some examples of standardized box sizes and styles include the European Federation of Corrugated Board Manufacturers (FEFCO) 416 (also known as the One Piece Folder, or OPF), the FEFCO 412, and the Regular Slotted Container, or RSC. These are only some examples, and it is appreciated that any number of other box styles and standardized box sizes and configurations may exist now or in the future. Moreover, a single automated converter may produce any number of different box styles.

Once a box template is formed a human generally must manually erect the box by folding the box template according to the pattern formed in the template. During the erecting process, sections of the box template are folded in a generally sequential order. It is often necessary to hold one section of folded box template in place while folding another section of box template in order to create the box. Holding a section of folded box template in place while folding another section often times creates difficulty in the erecting process. For example, by holding one section in place, the assembler may have only one hand available to fold, crease, or insert other sections. This may make it difficult, if not impossible, for a single person to erect certain styles and sizes of boxes alone. Thus, at least some styles of boxes require such a high level of involvement that usually two or more people must collectively erect the box. The FEFCO 416 is one example box style that typically requires more than one person during the process used to erect and assemble the box.

When more than one person is needed to erect a box, valuable human resources are spent on erecting the box. Moreover, even if a single person is able to erect a box alone, the process of erecting a box may be difficult and slow, thus again wasting valuable time and resources. Furthermore, due to the nature of erecting a box (e.g., having to hold certain portions of the folded template in place while folding other portions of the template), a difficult to assemble box may be erected with poor quality, thereby causing the box to be scrapped, thus wasting time and materials. Alternatively, a poorly erected box that is used to ship items may not have the requisite box integrity to protect the items placed in the box, thus increasing the risk of damage to the items located within the poorly erected box.

The subject matter disclosed and claimed herein is not limited to embodiments that solve any disadvantage or difficulties, or that operate only in environments such as those described above. Rather, this background is only intended to illustrate one exemplary technology area where some embodiments described herein may be practiced. Accordingly, foregoing description of boxes and corrugated board boxes is merely exemplary and it will be appreciated that any number of other products made from various other materials can also be erected in lieu of a corrugated board box.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to one embodiment, an erecting aid for erecting a box from a box template is disclosed. Such an erecting aid may include a generally planar table, a panel coupled to a side of the generally planar table, and a clamp portion. The clamp portion may be operatively associated with the table and can be biased towards a closed position and at least partially movable along the generally planar table. The generally planar table, panel, and clamp may collectively act to stabilize a box template. For instance, a box template that is partially folded and assembled may be maintained in the partially assembled state during an erecting process occurring on the generally planar table.

According to some embodiments, an erecting aid uses a table, clamp and panel to maintain a box template in a partially folded state in the absence of operator assistance. Moreover, in some embodiments, the box template may be maintained in a plurality of different partially folded states without operator assistance.

In embodiments that include a table and a panel, the panel and table may be positioned relative to each other such that the panel and table form an acute angle. The acute angle may be in a range between about eighty degrees and about eighty-seven degrees. Moreover, the angle may be adjustable. For instance, the angle may be selectively adjusted to be acute, right, or obtuse. In some cases, an adjustable panel support may be included such that the panel support enables the angle between a panel and table to be selectively adjusted.

A clamp as described herein may have multiple configurations. In one configuration, the clamp has at least two portions, including a first, stationary portion and a second, movable portion. The second clamp portion may be biased in a manner that creates a clamping force between the first and second clamp portions.

Erecting aids according to an embodiment of the invention include one or more tracks. For instance, a track may be included such that a clamp can move at least partially along the track. A movable portion of a clamp may, for instance, move along a track and is optionally biased. Any suitable biasing mechanism, such as a spring loaded tool balancer, may be used to bias such a movable portion.

In accordance with aspects described herein, a table, panel, and clamp can cooperatively be used to erect different types of boxes. Boxes of different styles (e.g., FEFCO, 416, FEFCO 412, RSC, or others) may be erected using an erecting aid, and the erecting aid may be usable with multiple styles or sizes of boxes with no change to a setup arrangement. A portion of a clamp, for example may simply be moved to a position corresponding to a size of a desired box, and the use of the erecting aid to assemble the box may be performed while the erecting aid applies a clamping force stabilizing and maintaining the box template in a partially assembled state during the erecting process.

Another example embodiment of an erecting aid includes a table and a panel that is adjustably coupled to a side of the table at an acute angle relative to the table. A track may cooperate with the table and a clamp may be operatively associated with the track. An exemplary clamp may include a stationary first portion and a movable second portion that is biased towards a first side of the erecting aid table. The erecting aid may hold in place folded portions of a partially folded corrugated box in an absence of operator assistance, and may hold the box template in different, partially folded states. If the erecting aid has a panel and table at an acute angle, the angle may be between about seventy-five and about ninety degrees.

An erecting aid may include clearance zones between clamp portions and a table. Such clearance zones may, for instance, permit clamp portions to compress opposing panels of a template such that the opposing panels offset a biasing force of the clamp. The clamping force may also hold a third folded portion of the box template in a folded position.

Movement of some example clamps may use a carriage. For instance, a movable portion of a clamp may include a carriage that interfaces with a track and is selectably movable along the track. If a biasing mechanism is used, a movable portion of a clamp may be biased towards a first side of a table. The biasing mechanism may be connected to a movable clamp portion and a frame that supports a table portion. The biasing mechanism may be a spring or a spring loaded devices.

Examples of erecting aids described can be used with FEFCO 416, FEFCO 412 and/or RSC style boxes. In some cases, multiple types of box styles and sizes can be used without modifying the setup arrangement of the erecting aid apart from movement of the clamp to exert a clamping force on the different styles and sizes of boxes.

A method of erecting a corrugated box is also described, and includes receiving a corrugated box template and making initial folds in the box template to form a partially folded box template. After making the initial folds, the partially folded template may be placed in an erecting aid and the erecting aid can be used to stabilize folded portions of the partially folded template even without user assistance. Additional folds may then be used to completely erect the box. Stabilizing the template may include inserting one or objects that are to be enclosed in the box prior to performing additional folds to completely erect the corrugated box. Alternatively the additional folds can be performed without inserting an object into the interior of the box. The folded box may have a FEFCO 416 style. In such a case, making initial folds may include Making the additional folds may include folding one or more side panels to be about perpendicular to a bottom panel. One or more front flaps can be folded to be about perpendicular to the bottom panel, and a rear panel can be folded to be about perpendicular to the bottom panel. One or more rear flaps may also be folded to be about perpendicular to the bottom panel and one or more side panels.

The erecting aid used to perform a method of erecting a corrugated box may have a generally planar table surface, a panel at an acute angle to the planar table surface, and a clamp that has a movable, biased member that exerts a clamping force to maintain a partially folded corrugated box template in a partially folded state, even without user assistance.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS/APPENDIX

To further clarify the Summary above and other advantages and features of the present invention, a more particular description of the invention will be rendered by reference to specific embodiments that are illustrated in the appended drawings. It is appreciated that these drawings depict only typical embodiments of the invention and, therefore, are not to be considered limiting of its scope. Furthermore, while various embodiments illustrated are drawn to scale, they are merely exemplary, and are not necessarily to scale for all embodiments. The invention will be described and explained with additional specificity and detail through the use of the accompanying drawings in which:

Figure 9:
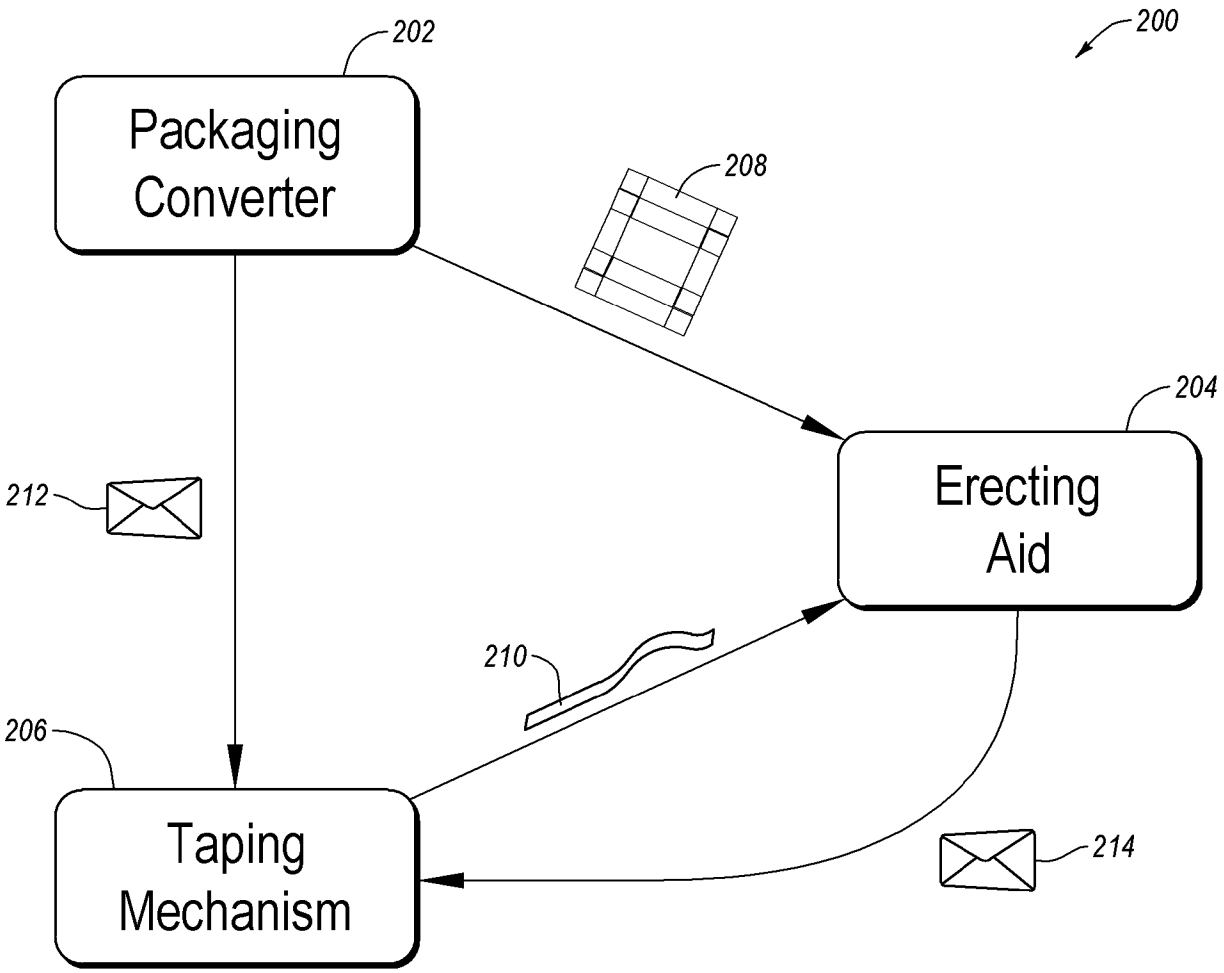
Figure 10:
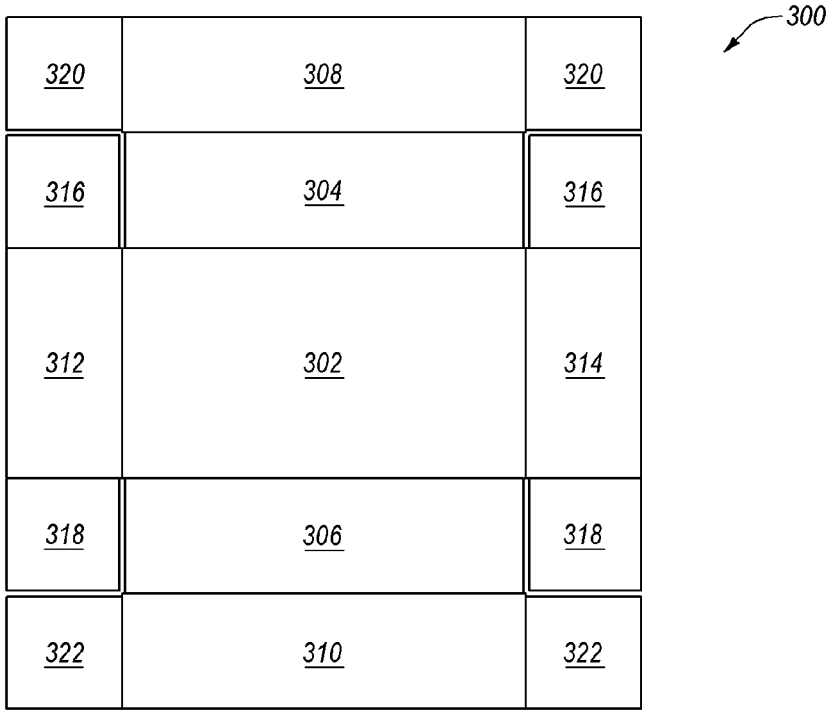

FIG. 9 schematically illustrates a packaging production and assembly system according to one example embodiment;

FIG. 10 illustrates an example box template that may be assembled using the various erecting aid embodiments disclosed herein; and FIGS. 11-17 illustrate various example steps in a method for assembling the box template of FIG. 10 using an erecting aid.

DETAILED DESCRIPTION OF SOME EXAMPLE EMBODIMENTS

The embodiments described herein extend to methods, devices, systems, assemblies, and apparatus for erecting packaging materials. More particularly, the following description will particularly describe methods, devices, systems, assemblies, and apparatus for assembling and erecting boxes made from corrugated board. It will be appreciated, however, that the example embodiments and invention disclosed herein are not limited to production of boxes or use with corrugated board, and such a description is provided merely to illustrate an example environment in which the disclosed invention may be used.

Reference will now be made to the drawings to describe various aspects of exemplary embodiments of the invention. It is understood that the drawings are diagrammatic and schematic representations of such exemplary embodiments and are not intended to limit the present invention, except to the extent expressly claimed. Similarly, no particular elements should be considered essential for all embodiments, nor should any elements be interpreted as requiring assembly or manufacture in any particular order or manner. Accordingly, no inference should be drawn from the drawings as to the necessity or ordering of any element. In the following description, numerous specific details are set forth in order to provide a thorough understanding of the present invention. It will be obvious, however, to someone of ordinary skill in the art that the present invention may be practiced without these specific details. In other cases, general manufacturing techniques and packaging products are not herein described in detail in order to avoid unnecessarily obscuring the novel aspects of the present invention.

Figure 1:
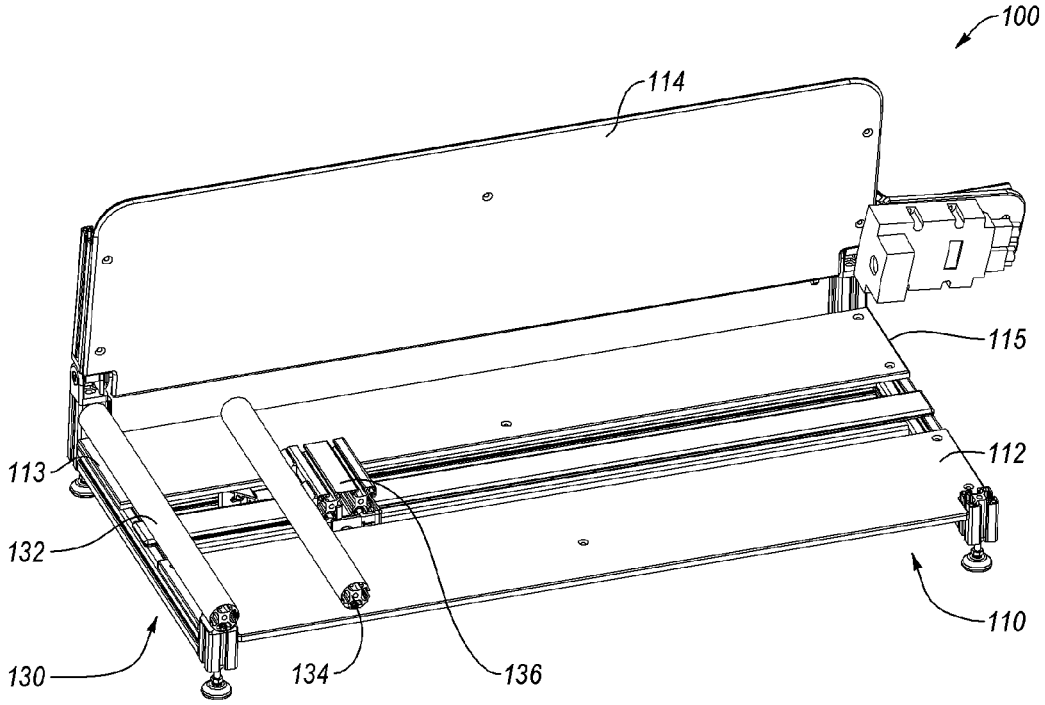
FIG. 1 illustrates an perspective view of an example erecting aid according to some embodiments of the present invention, in which a movable clamp operates in connection with a table surface.
Figure 2:
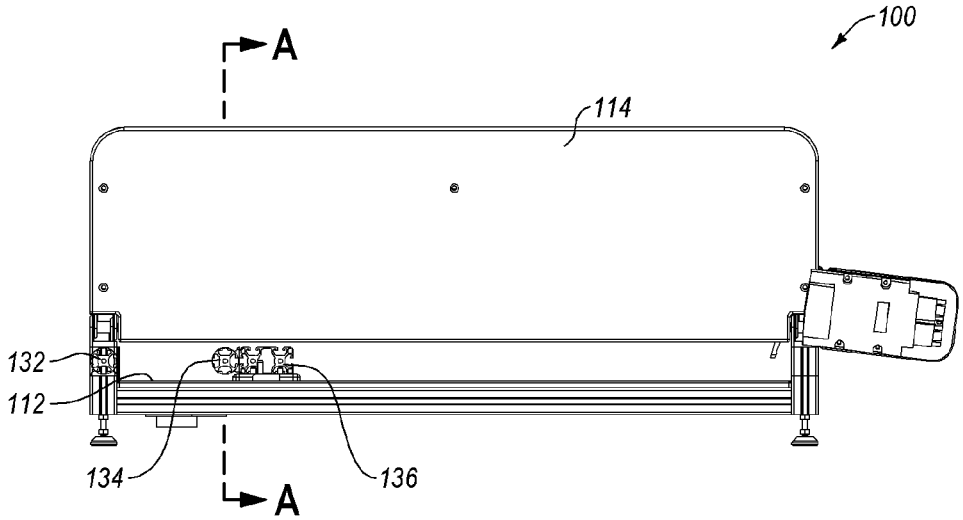
FIG. 2 illustrates a front view of the example erecting aid of FIG. 1.

FIGS. 1-8 and the following discussion are intended to provide a brief general description of an example embodiment of an erecting aid 100. As illustrated in FIGS. 1 and 2, for example, an example erecting aid 100 may include a table portion 110 and a panel 114 offset at an angle from table portion 110. Table portion 110 and panel 114 may have a variety of different configurations and sizes. According to one example configuration, table portion 110 includes a table surface 112 made of one or more discrete components. Table surface 112 may have a proximal end 113 and a distal end 115.

In the illustrated embodiment, a clamp 130 is operatively associated with table surface 112. Clamp 130 is, in some embodiments, positioned adjacent proximal end 113 of table surface 112 and/or is a selectively adjustable and movable clamp. In particular, according to some embodiments, one or more portions of clamp 130 may be movable relative to other portions of clamp 130. For instance, in the illustrated embodiment, clamp 130 includes a first clamp portion 132 that is adjacent proximal end 112 of table surface 112. A second clamp portion 134 is, in this embodiment, also included and is positioned proximate to table surface 112, but is laterally offset from first clamp portion 132. In particular, second clamp portion 134 may be positioned between first clamp portion 132 and distal end 115.

According to at least some embodiments, second clamp portion 134 may be selectively movable relative to first clamp portion 132. For instance, in the illustrated embodiment, second clamp portion 134 is optionally coupled to a carriage 136. The carriage 136 may facilitate the movement of second clamp portion 132 relative to first clamp portion 132 and/or table surface 112. More particularly, second clamp portion 132 may slide, translate, or otherwise move relative to table surface 112. In some embodiments, first clamp portion 132 may be fixed such that it does not move relative to table surface 112; however, in other embodiments, first clamp portion 132 may be selectively movable so that it can move relative to table surface 112. In embodiments where first clamp portion 132 is movable, first clamp portion 132 optionally moves independent of second clamp portion 134, or at a different time and/or speed than second clamp portion 134, or in a different direction. For instance, in another embodiment, clamp 130 may be substantially centered on a portion of table surface 112. First and second clamp portions 132, 134 could be tethered such that as one moves, the other moves in an opposing direction to provide a clamping force.

As described in additional detail herein, first and second clamp portions 132, 134 can be configured to cooperate so as to provide a clamping force on an object. That clamping force may, for example, clamp on a box template made from corrugated board, and optionally hold the box template in a particular folded, unfolded, or partially folded configuration. Further, the box template may be held in a generally upright position so that a user may efficiently fold and erect other portions of the box template. Panel 114 may further hold a wall of corrugated board or other packaging materials in a generally upright position, thus permitting a human or mechanical operator to continue to erect the box template without having to hold that particular wall of corrugated board in place. As discussed hereafter, clamp 130, table surface 112, and/or panel 114 may operate to hold a box panel along panel 114 at an acute angle relative to one or more box panels aligned along table surface 112. In some embodiments, flap portions of the corrugated box template may be pressed into other portions of the box template to in turn hold portions of the box template in place while the user continues erecting other portions of the box template.

Moreover, as second clamping portion 134 may be configured to be movable along table surface 112, second clamping portion 134 may have any of an infinite number of discrete positions between proximal end 113 and distal end 115. The selective positioning of second clamp portion 134 may allow erecting aid 110 to be used in connection with any number of different sizes and configurations of box templates. More particularly, erecting aid 100 can in some embodiments accommodate a wide range of box sizes and configurations through the mere adjustment of the position of second clamp portion 134, without any additional change to the setup arrangement of erecting aid 100.

As best illustrated in FIG. 2, first and second clamp portions 132, 134 optionally have a generally circular cross-sectional shape, and are comprised of substantially cylindrical rods. As such, a contact surface between first and second clamp portions 132, 134 is generally round. However, in alternative embodiments, first and second clamp portions 132, 134 may have other shapes and configurations, and the contact surface may not be round. For example, contact surface may be substantially flat in other embodiments. In another alternative embodiment, the contact surface may come to a point, such as where a cross-sectional shape is triangular. The shape of the first and second clamp portions 132, 134 may determine the extent to which a corrugated wall of a box template is pressed toward table portion 110 during the erecting process.

Not only may the shapes of first and second clamp portions 132, 134 vary from one embodiment to the next, but they also may vary from one another within the same embodiment. For example, the first clamp portion 132 may have a cylindrical cross-sectional shape while second clamp portion 134 has a rectangular, oval, or other cross-sectional shape.

In addition to variations with the shape of the corrugated board contact surface on clamp portions 132, 134, the clearance distance between clamp portions 132, 134 and table surface 112 may vary from one embodiment to the next. For example, FIG. 2 illustrates one example embodiment where the clearance is less than the radius of the cross-sectional shape of clamp portions 132, 134. Thus clearance may be very slight depending on the size of clamp portions 132, 134; however, in other embodiments the clearance may be larger or smaller. For instance, depending on to what extent it is desirable to press a corrugated wall of a box template towards the center of the corrugated box template, the height of one or both of clamp portions 132, 134 may vary. In particular, the greater the clearance between clamp portions 132, 134 and table surface 112, the greater the extent that a corrugated wall of a box template may be pressed toward table surface 112 during the erecting process. The clearance between second clamp portion 134 and table surface 112 may also differ from the clearance between first clamp portion 132 and table surface 112 within the same embodiment. Further, in some embodiments, first and second clamp portions 132, 134 are adjustable such that the clearance height can be selectively controlled and adjusted.

Figure 3:
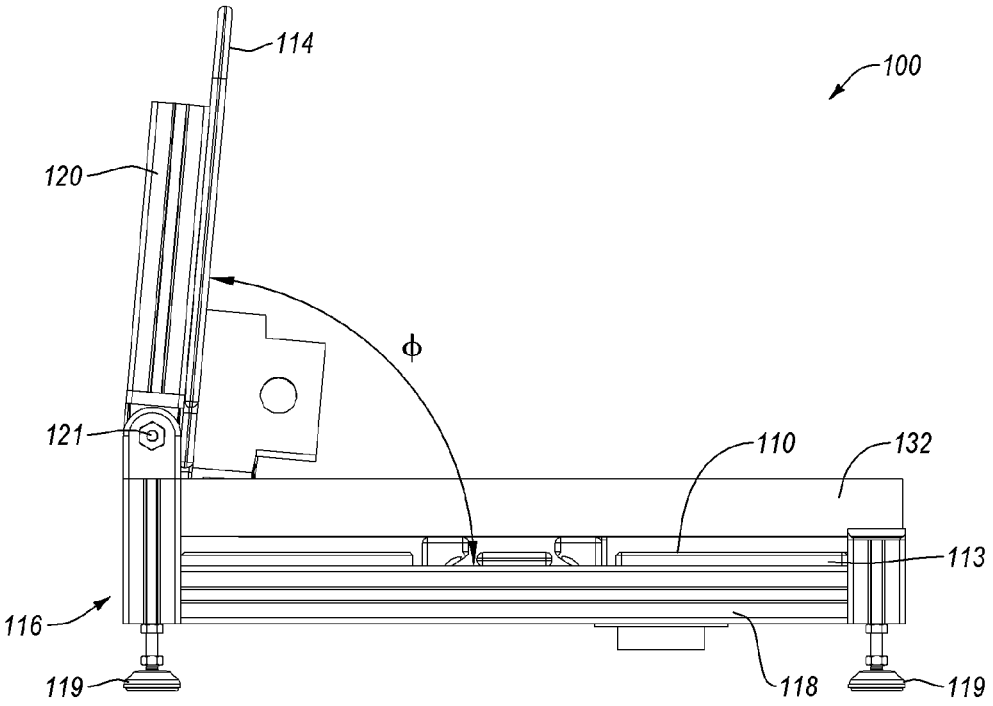
FIG. 3 illustrates a first side view of the example erecting aid of FIG. 1.
Figure 4:
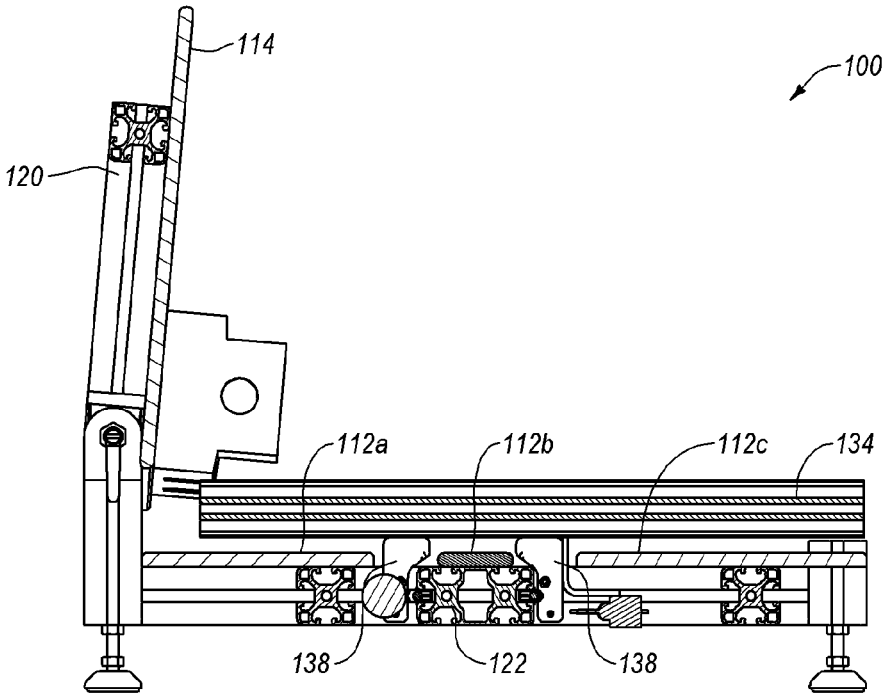
FIG. 4 illustrates a cross-sectional view of the example erecting aid of FIG. 1, along the line A-A of FIG. 2.
Figure 5:
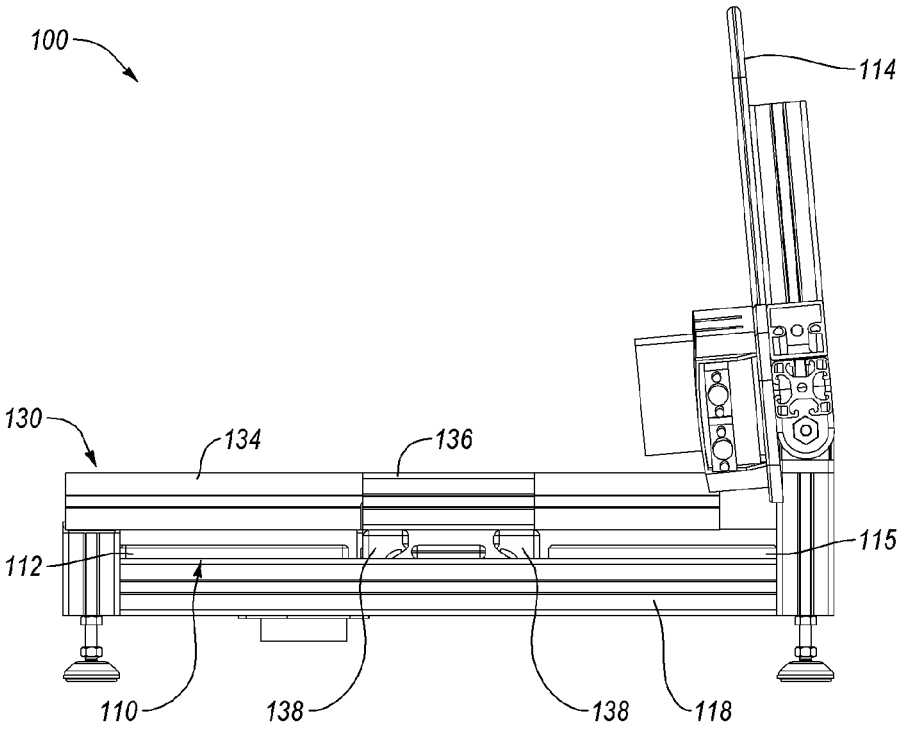
FIG. 5 illustrates a second side view of the example erecting aid of FIG. 1.

Turning now to FIGS. 3-5, a more particular description of the illustrated embodiment of erecting aid 100 and clamp 130 is provided. For instance, FIG. 3 illustrates a side view of erecting aid 100 as viewed from proximal end 113. As shown in FIG. 3, for example, first clamp portion 132 may be positioned at proximal end 113 and may be usable to, for example, act in concert with second clamp portion 134 (see FIG. 4) to exert a clamping force on an object contained at least partially between first and second clamp portions 132, 134.

As also illustrated in FIG. 3, a support structure 116 may be used to support table portion 110 and panel 114 on another surface. For instance, erecting aid 100 may be positioned, for example, on a generally horizontal surface such as a table, floor, or desk. Support structure 116 may then provide support so as to maintain table portion 110 and panel 114 in a generally stationary position during use of erecting aid 100.

Support structure 116 may include, in example embodiments, a support frame 118 and a panel support 120. Support frame 118 may act as a table support in some embodiments. For instance, as shown in FIG. 3, table portion 110 may be positioned and/or secured to support frame 118. Support frame 118 may support the weight of table portion 110 so as to maintain table portion 110 in a generally constant position. Support frame 118 may have a number of different sizes and configurations. For example, support frame 118 may have an outer structure that generally corresponds to the shape of table portion 110. Additionally, or alternatively, support frame 118 may have one or more internal cross-braces or other structures that support table portion 110. Optionally, one or more feet supports 119 may be connected to support structure 116 and/or table portion 110. Such feet supports 119 may be adjustable to account for variations in the surface on which erecting aid 100 is placed and/or otherwise elevate erecting aid 100 from a lower surface.

Panel 114 may optionally be included in erecting aid 100, and may also be positioned relative to table portion 110 through the use of a panel support 120. In the illustrated embodiment, panel support 120 may also take the form of a support frame that generally provides support to all or a portion of panel 114. For instance, in FIGS. 3-5, panel support 120 supports only a portion of panel 114, while an uppermost portion of panel 114 extends beyond panel support 120. In other embodiments, however, panel support 120 may extend the full length and/or width of panel 114.

As briefly mentioned above, an additional example aspect of the invention may be support structure 116. As shown in FIGS. 3-5, support structure 116 may provide basic support to erecting aid 100, and can support and/or stabilize table portion 110, track 122, panel 114, biasing mechanism 170 (see FIG. 8), and/or sensor 160 (see FIG. 6). Support structure 116 may be made from a variety of materials such as metal (e.g., aluminum), organic materials, plastics, composites, and/or any other material or combination of material that provides sufficient rigidity to support erecting aid 100. Additionally, the geometric configuration of support structure 116 may vary as well. For example, support structure 116 may be made from beams having a generally hollow and square cross-section. However, this shape is for exemplary purposes only, and support structure 116 may take almost any geometric shape and configuration. Moreover, the location of each of the members of support structure 116 may vary from one embodiment to the next. It can be understood that members of support structure 116 may be located in variety of locations, and the locations illustrated in FIGS. 1-8 are only exemplary in nature.

As further illustrated in FIGS. 3-5, in some embodiments, an angle $\phi$ may be formed between panel 114 and table portion 110, and/or between panel support 120 and support frame 118. In the illustrated embodiment, angle $\phi$ is an acute angle, although in other embodiments angle $\phi$ may be varied. For instance, in this embodiment, support frame 118 connects to panel support 120 at a pivot 121. Panel support 120 may thus hinge and pivot relative to support frame 118 so as to vary angle $\phi$, although in other embodiments panel support 120 may be at an angle that is fixed relative to support frame 118. In some embodiments, angle $\phi$ may be continuously variable between about zero and about one-hundred eighty degrees. In other embodiments, angle $\phi$ may have a discrete number of locations. For instance, panel support 120 may be able to be locked in place at only certain angles $\phi$ relative to support frame 118.

In some embodiments, erecting aid 100 may have a first configuration in which panel support 120 is rotated clockwise as viewed in FIG. 3, such that angle $\phi$ is about zero degrees and panel 114 is generally parallel to table portion 110. Such a configuration may be useful where, for example, erecting aid 100 is not in use and is being stored. Similarly, by rotating panel 114 counter-clockwise to form an obtuse angle $\phi$ of about one-hundred eighty degrees, the width of erecting aid 100 may be increased while the height of erecting aid 100 is decreased, thereby also allowing erecting aid 100 to be more easily stored in some locations. An obtuse angle $\phi$ less than one-hundred eighty degrees may also be desirable in some circumstances, such as where certain box styles have particular panel that bends at an obtuse angle rather than an acute or right angle during the erecting process.

The particular embodiment illustrated in FIGS. 3-5 includes panel 114 at an acute angle $\phi$ relative to table portion 100. According to some embodiments, angle ϕ may be acute during the use of erecting aid 100 to erect and assemble boxes. For instance, the acute angle ϕ may create an acute angle between flaps of the box template clamped between first and second clamp portions 132, 134. The acute angle ϕ may thus cooperate to press one or more first flap portions of a corrugated box template into other portions of the corrugated box template, thereby holding the portions of the box template in place while the operator continues to erect and assemble the box.

The desired measurement of angle ϕ may vary based on the design and configuration of erecting aid 100, the box template being assembled, or other factors. Accordingly, in one embodiment, angle ϕ may be between about sixty degrees and about one-hundred twenty degrees. More particularly, angle ϕ may measure between about seventy-five and about one hundred five degrees, and in still more particular embodiments, may measure between about eighty and about eighty-seven degrees.

With reference now to FIGS. 4 and 5, a more particular description of the manner of operation of clamp 130 is provided. FIG. 4, for instance, illustrates a cross-sectional view of erecting aid 100 as viewed along line A-A in FIG. 2. The illustrated cross-sectional view provides a look at various interior components of erecting aid 100, including the exemplary operation of carriage 136.

In the example shown in FIG. 4, second clamping portion 134 is connected to carriage 136. Carriage 136 may, in turn, be connected to one or more sliders 138. Sliders 138 extend, in this embodiment, in a generally downward direction from carriage 136. The positioning of sliders 138 may correspond to one or more grooves in table surface 112. In this example, for instance, table surface 112 has three discrete portions. A first table portion 112*a* is positioned proximate panel 114, while second and third table portions 112*b*, 112*c* are located more distal relative to panel 114. In particular, in the illustrated embodiment, second table portion 112*b* is an intermediate portion and is positioned between two opposing grooves into which sliders 138 are positioned.

Also generally corresponding with intermediate, second table portion 112*b* in this example embodiment is a track 122. Track 122 may have any suitable configuration. In this particular example embodiment track 122 has a generally rectangular cross-sectional shape and has a height and shape generally corresponding to a profile on sliders 138. That is to say, sliders 138 and track 122 are configured to cooperate so as to allow sliders to move along track 122, thereby also moving carriage 136 and second clamp portion 134 along track 122. Track 122 may thus be made from a bar of material that has sliders 138 pass therearound. In other embodiments, track 122 may have one or more rails formed thereon to allow rollers or other members to easily move therealong.

According to one example embodiment, carriage 136 may also be configured to move along track 122 in any suitable manner, such as in the manners described herein or as will be appreciated by one skilled in the art in view of the disclosure herein. Optionally, a low friction interface between carriage 136 and track 122 may be used to facilitate moving of sliders 138 and carriage 136 along track 122. For instance, a low friction material or coating may be used for sliders 138 and/or track 122. Examples of a low friction material and/or coating may include polytetrafluoroethylene (PTFE), TEFLON, or other materials. Moreover, such low friction materials and coatings may be applied to substantially the entire surface of sliders 138 and/or track 122, but in other embodiments are applied only to limited portions, such as contact locations. In other embodiments, ball bearings, rollers, or solid or fluid lubricants may provide a low friction interface between track 122 and carriage 136 and/or sliders 138.

FIG. 5 also illustrates carriage 136 and sliders 138. As best seen in FIG. 5, which is a side view from the distal end 115 of table surface 112, sliders 138 may extend below table surface 112. In this embodiment, table surface 112 is positioned about immediately above support frame 118. As a result, as sliders 138 are moved towards distal end 115 along track 122 (see FIG. 4), sliders 138 may engage against support frame 118, thereby substantially preventing sliders 138 from moving beyond distal end 115. As a result, sliders 138 may act as a stop to prevent a user from inadvertently pulling second clamp portion 134 off track 122. It will be appreciated, however, that such a stop mechanism is optional, and that in some embodiments, the stop mechanism may be omitted. In still additional embodiments, other type of stop members may be used. For example a bar or rod may be positioned at distal end 115 of table surface 112 and fixed in place to substantially prevent second clamp portion 134 being removed from track 122.

As one skilled in the art will appreciate in view of the disclosure herein, the illustrated and described configurations of erecting aid 100 are merely exemplary and are not intended to limit the scope of the claimed invention. Rather erecting aid 100 may be varied in any number of manners and in accordance with the invention contemplated herein. Table portion 110 and/or panel 114, for example, may vary from the illustrated configuration, and may be made of any of a number of types of different materials. Some example table portion materials include various metals, plastics, composites, organic materials (e.g., wood), and/or any combination of these or other materials. In one example embodiment, each of panel 114 and table surfaces 112*a*, 112*b*, 112*c* is made of the same material. In other embodiments, panel 114 and/or table surfaces 112*a*, 112*b*, 112*c* may be different materials. For instance, first and third table surface portions 112*a*, 112*c* may be one material, while second table surface portion 112*b* is made of a different material. The second table surface portion 112*b* is optionally made of a low friction material, or has a low friction coating, such that carriage 136 coupled to the second clamp portion 134 may easily slide along the length of track 122. First and third table surface portions 112*a*, 112*c* are optionally formed of a higher friction material, or have a suitable higher friction coating, that may be configured to grab and hold a box template to prevent slippage while erecting aid 100 securely holds the box template during the erecting process.

In one example embodiment, portions of table portion 110 may have indentations, protrusions or other features designed to engage and hold an object in place, such as rubber grabbers placed in various locations along the table portion 110.

Another geometric configuration that may vary is the thickness of the table portion 110 and/or panel 114, or the thickness, dimensions, and size of support structure 116. In some example embodiments, it may be desired to have table portion 110 be as thin as is practical in order to reduce the weight of erecting aid 100 such that erecting aid 100 may be more easily moved from one location to another by a user manually carrying erecting aid 100. Adjustments of the angle of panel 114 relative to table portion 110 may also be more easily made if a lightweight material and/or thin material is used for panel 114. Moreover, the width, length, and/or height of table portion 110 and/or panel 114 may take almost any dimension depending on the type of material used, the desired weight specifications, the range of object sizes desired to be usable with erecting aid 100, and the like.

Figure 6:
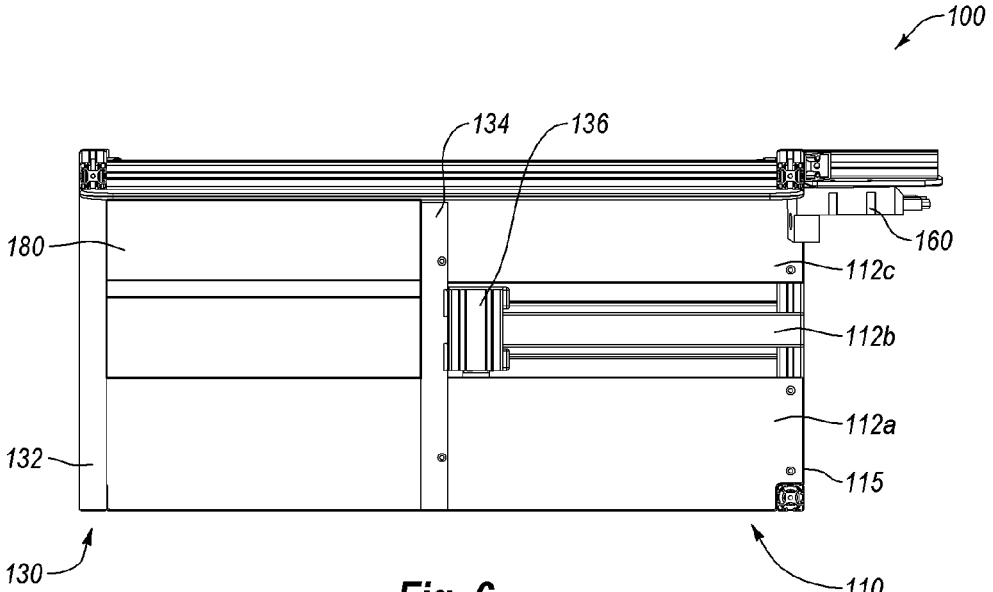
FIG. 6 illustrates a top view of the example erecting aid of FIG. 1, and illustrates the movable clamp moved to a position facilitating construction of a box.

Turning now to FIG. 6, an example embodiment of erecting aid 100 is illustrated as used to clamp a box template 180 in place. In this embodiment, box template 180 is in a folded and assembled state; however, as discussed hereafter, erecting aid 100 may be similarly used during the erecting and assembly process, so as to clamp box template 180 in place at an unassembled and/or partially assembled state.

With reference to FIG. 6, it will be appreciated that second clamping portion 134 has been moved from a proximal position to a more distal position. The particular position of second clamping portion 134 in this example embodiment corresponds to the size of box template 180, such that the distance between first and second clamping portions 132, 134 generally corresponds to the width of box template 180. The movement of second clamping portion 134 in a distal direction may be facilitated by carriage 136 which can move along a track 122 and through grooves between first and second table portions 112*a*, 112*b*, and between second and third table portions 112*b*, 112*c*.

FIG. 6 further illustrates that first and second clamping portions 132, 134 may have a configuration in which they extend substantially the entire width of table surface 112. For instance, first and second clamping portions 132, 134 may be bars or rods and sized to correspond to table surface 112. In other embodiments, however, first and second clamping portions 132, 134 may have other configurations. For instance, first and second clamping portions 132, 134 may have a plated construction and/or may be sized to be larger or smaller than table surface 112.

As further illustrated in FIG. 6, erecting aid 100 may also include, in some embodiment, a sensor 160. Sensor 160 may be used for a variety of different purposes. According to one aspect of the present invention, sensor 160 may be a positional sensor that detects the position of second clamping member 134 and/or a position of box template 180. For instance, by detecting the particular position of a distal end of box template 180, sensor may be used to determine the width or length of box template 180 when fully erected. Sensor 160 may in turn connect to a tape dispensing mechanism that can then dispense an amount of tape directly corresponding to the sensed size of box template 180. In addition, sensor may have an input device which, when selected, automatically sends the sensed dimensions of box template 180 to a tape dispenser and/or sends a request signal requesting dispensing of tape. In still other embodiments, sensor may connect to an automated taping machine that may automatically tape box template 180, without dispensing a quantity of tape to the operator of erecting aid 100.

Sensor 160 may also be used for other purposes. For instance, sensor 160 may detect the position of carriage 136. If carriage 136 is approaching distal end 115, a stopping mechanism may be deployed to restrict the movement of carriage 136 and prevent second clamping portion 134 from separating from carriage 136 and/or track 122.

As shown in FIG. 6, table portion 110 is illustrated as having a generally rectangular shape. This is for exemplary purposes only, and the table may take any shape such an oval, square, or any other shape that provides a suitable table portion 110 for facilitating erecting of a box template or other object, and/or for use with a track 122. In addition to various shapes, other geometric configurations of the table may vary. For example, the size (e.g., the length and/or the width) of the table portion 110 may vary from one embodiment to the next, as may the shape size, and positioning of various table surface portions 112*a*, 112*b*, 112*c*. In one embodiment, table portion 110 and/or clamp 130 is sized appropriately to aid in erecting boxes of the model and style FEFCO 416, FEFCO 412, and/or RSC. However, table portion 110 and clamp 130 may be sized appropriately to aid in erecting boxes of any style, model and/or size and is not limited to these styles alone, nor is erecting aid 100 limited such that it must be capable of use with any or all of the aforementioned styles. Moreover, an erecting aid 100 sized to aid in erecting the FEFCO 416, FEFCO 412 and/or RSC box styles may also aid erecting additional box styles and is not limited in any way to any or all of these three example box styles that are used for exemplary purposes only.

The configuration of panel 114 may also vary from one embodiment to the next. For example, panel 114 may be made from a single piece of material and/or be integrally formed with panel support 120. In an alternative embodiment, panel 114 may be made from several pieces of material. For example, panel 114 could me made up of a plurality of beams that extend across portions of panel support 120. Additionally while panel 114 may have a generally rectangular shape, panel 114 may vary and can take almost any shape or combinations of shapes.

Figure 7:
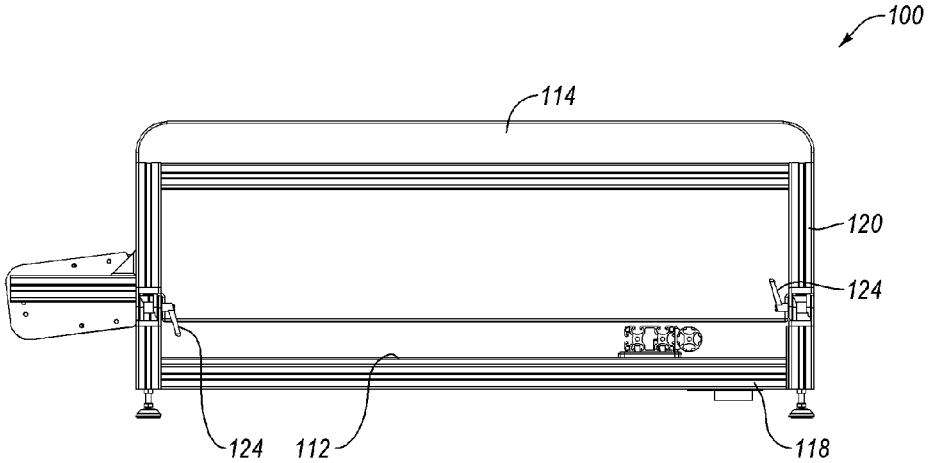
FIG. 7 illustrates a rear view of the example erecting aid of FIG. 1.
Figure 8:
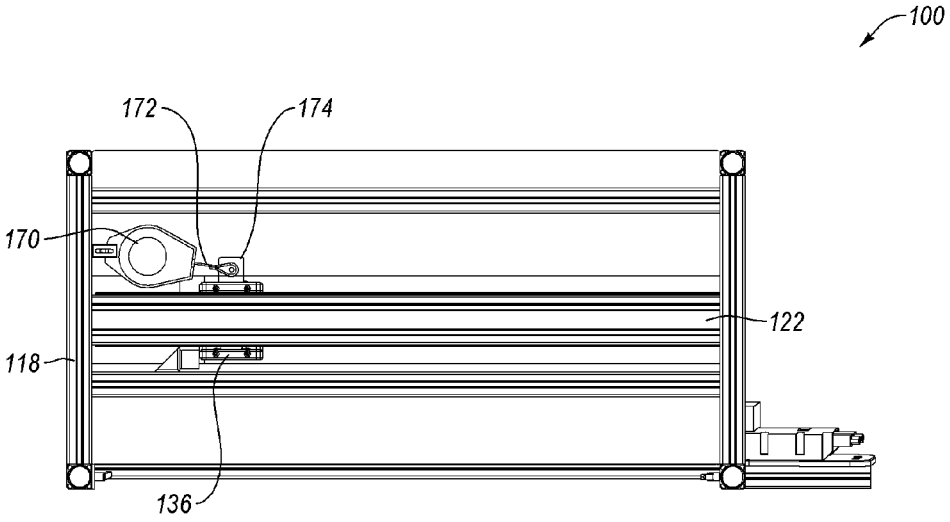
FIG. 8 illustrates a bottom view of the example erecting aid of FIG. 1.

FIGS. 7 and 8 illustrate still other aspects of example embodiments contemplated within the scope of the invention described herein. FIG. 7, for instance, illustrates a back-side view of an erecting aid 100. As described previously, a panel 114 may be positioned at an angle relative to a table surface 112. In this embodiment, panel 114 is supported by a panel support 120 that is also at an angle relative to a support frame 118 that supports table surface 112. In some embodiments, the position of panel support 120 may be selectively adjustable relative to support frame 118. For instance, a pivot connection between panel support 120 and support frame 118 may allow rotation of panel support 120 relative to support frame 118. It may also be desirable to lock panel support 120 at a particular location relative to support frame 118. To that end, a locking mechanism 124 may be used to selectively lock support frame 118 and panel support 120 at particular relative positions. For instance, locking mechanism 124 may be a bolt or other fastener that may be loosened to allow panel support 120 to pivot around a pivot point. In another embodiment, locking mechanism 124 may be a quick release mechanism. In still another embodiment, locking mechanism 124 may include an angle plate with particular openings, and a biased pin on panel support 120 may be depressed to allow rotation around a pivot, and then may engage at a subsequent opening. One skilled in the art will appreciate that locking mechanism 124 may also take a variety of other forms.

With reference now to FIG. 8, a bottom view of an exemplary erecting aid 100 is illustrated. In FIG. 8, erecting aid 100 also includes a biasing mechanism 170. In the particular embodiment illustrated, biasing mechanism 170 connects to support frame 118 and to a receiving component 174 on carriage 136. In this particular embodiment, biasing mechanism 170 may include a cord member 172 extending from biasing mechanism 170 and connecting to receiving component 174. Accordingly, as carriage 136 moves distally along track 122, cord member 172 may uncoil from within tension biasing mechanism 170. A spring or other biasing member may thereby be placed in a stressed state, such that biasing mechanism 170 also acts as a resistance provider. At the position of carriage 136 illustrated in FIG. 8, biasing mechanism 170 may be in an unstressed state, whereas at the position of carriage 136 in FIG. 6, a corresponding biasing mechanism 170 may be in a stressed state. Biasing mechanism 170 may thus bias carriage 136 and second clamping portion 134 towards a particular location.

The resistance that biasing mechanism 170 provides may provide a number of different purposes. For example, the resistance to movement of carriage 136 may facilitate smooth, even movement of carriage 136 along track 122. Furthermore, the biasing force offered by biasing mechanism 170 may provide a clamping force between first and second clamping portions 132, 134. In particular, carriage 136 may be moved along track 122 to accommodate a box template or other object that is placed between first and second clamping portions 132, 134. The movement of carriage 136 can place biasing mechanism 170 in a stressed state. In such a stressed state, cord member 172 may carry a tension that is transferred to second clamping portion 134. This tension may then create a force on the box template to hold the box template stationary, and the walls of corrugated board in a generally upright portion so that an operator is able to fold and erect other portions of a corrugated box template.

It should be appreciated by one skilled in the art in view of the disclosure herein that any number of different biasing mechanisms may be used, and biasing mechanism 170 may supply a range of resistive and/or biasing forces to at least second clamp portion 134. In one example, the resistance force supplied by biasing mechanism 170 is of a force that is relatively easy for a human to overcome, while at the same time providing sufficient force to securely hold a partially folded corrugated box in place. An example biasing mechanism 170 may use a mechanical spring (e.g., a spring-loaded tool balancer) or compress a compressible fluid (e.g., air spring) to provide a resistive and/or biasing force. Of course, other types of resistance mechanisms or biasing members other than springs may also be used.

Furthermore, while biasing mechanism 170 is illustrated on the underside of erecting aid 100, this is also merely exemplary. In other embodiments, biasing mechanism 170 may be on any other side of erecting aid 100, and may not even attach to support frame 116 or carriage 136 in other embodiments. For instance, biasing mechanism 170 may attach to, or be incorporated within, second clamp portion 134. In some cases, such as where cord member 172 is used, cord member 172 may be retractable into biasing mechanism 170. For instance, a spring loaded biasing mechanism 170 may automatically retract cord member 172 when movement of carriage 134 is not restricted (e.g., by a box template between first and second clamp portions 132, 134). In other embodiments, a release button may be depressed before activating retraction of cord member 172.

Before describing in additional detail a particular manner of using an example erecting aid in the assembly of a box template, reference will briefly be made to FIG. 9, which schematically illustrates an example packaging production and assembly system 200 according to some aspects of the present invention. In particular, packaging production and assembly system includes a packaging converter 202 and an erecting aid 204. Packaging converter 202 may be any manual or automated machine now used, or in the future developed, to produce packaging templates that need some assembly. As illustrated in FIG. 9, a box template 208 may be produced by packaging converter 202 and provided to erecting aid 204. Erecting aid 204 may then be used to assemble and erect box template 208. For instance, erecting aid 204 may be similar to erecting aid 100 as described with reference to FIGS. 1-8, and optionally provides a clamping force on box template 208 during assembly.

Optionally, system 200 may also include a taping mechanism 206. Taping mechanism 206 may be a tape dispenser, automated taping machine, or some other type of tape or even gluing mechanism. According to one embodiment, taping mechanism 206 is used to seal box template 208 once box template 208 is assembled, or to otherwise provide support that maintains box template 208 in an assembled state. Taping mechanism 206 may, for example, receive and measure assembled box template 208, and then dispense tape of a certain size, or automatically apply tape to the assembled box template 208.

In other embodiments, taping mechanism 206 receives input from one or more of packaging converter 202 and/or erecting aid 204. For instance, packaging converter 202 may provide to taping mechanism 206 a measurement of template 208, and indicating the particular size of tape that will be needed to secure box template 208 in its assembled state. Such information may be conveyed through a message 212 between packaging converter 202 and taping mechanism 206. In another embodiment, erecting aid 204 may include a sensor or other measurement component that can determine the size of an assembled box template 208. Erecting aid 204 may then be equipped to send a message 214 to taping mechanism 206, so that a proper amount of tape 210 may be dispensed or applied to the assembled box template 208.

Messages 212, 214 may be conveyed between the components in FIG. 9 in any suitable manner. For instance, in one embodiment, packaging converter 202, erecting aid 204, and/or taping mechanism 206 are equipped to communicate over a network. As such, packaging converter 202, erecting aid 204, and/or taping mechanism 206 may have a wireless or wire connection through the network, such that electronic messages may be conveyed. In still other embodiments, packaging converter 202 and/or erecting aid 204, may output physical messages. For instance, a printer may print information about the size of tape needed, and an operator of erecting aid 204 can then input that particular size into taping machine 206 for dispensing or application of a desired amount of tape or glue.

A method for erecting a box using an erecting aid will now be particularly described with reference to FIGS. 10-17. The described method may be performed manually by a single operator or by using one or more mechanical and/or electrical actuators or machines. The method referenced in connection with FIGS. 10-17 is described as erecting a box while inserting another box object therein. It should be appreciated, however, that this is exemplary only, and that the method described relative to FIGS. 10-17 may also apply equally to erecting a box even if the box remains empty while on an erecting aid.

FIGS. 10-17 describe the process with reference to a box template similar to a FEFCO 416 box and can also work with a FEFCO 416 box. The example box is, however, exemplary only, and erecting aid 100 may be used with various sizes, styles and models of boxes.

The order of steps illustrated in FIGS. 11-17 may also vary even for the illustrated box template style, and may further vary depending on the box model and style to be erected. The illustrated method steps, however, are useful to show various functions and aspects of an erecting aid according to embodiments of the present invention, particularly with regard to stabilizing a partially erected box template so that an operator can use both hands to fold or manipulate flaps or panels, without requiring the user to hold other panels or flaps in place. With other example box models, the steps shown may also be performed in a different order, or alternatively, an erecting aid may use different modes to hold a partially folded corrugated board box in place, depending on the particular style and/or size of the box template erected using the erecting aid.

FIG. 10 illustrates an example box template 300 that may be erected using an erecting aid as described herein. As noted previously, box template 300 may have any of a number of different styles, although box template 300 is illustrated as having a style similar to an FEFCO 416 template. In effect, box template 300 comprises a set of panels 302-314 and flaps 316-322. For simplicity, the term "panels" is used in this description to refer to portions of box template 300 that will form the visible, outer surfaces of an assembled box, while the term "flaps" is used to refer to portions of box template 300 which are interior to the assembled box. It should be appreciated that the terms "panels" and "flaps" are merely used to identify different portions of box template 300, and all portions of box template 300 could be referred to as panels, flaps, portions, or using other nomenclature.

Figure 11:
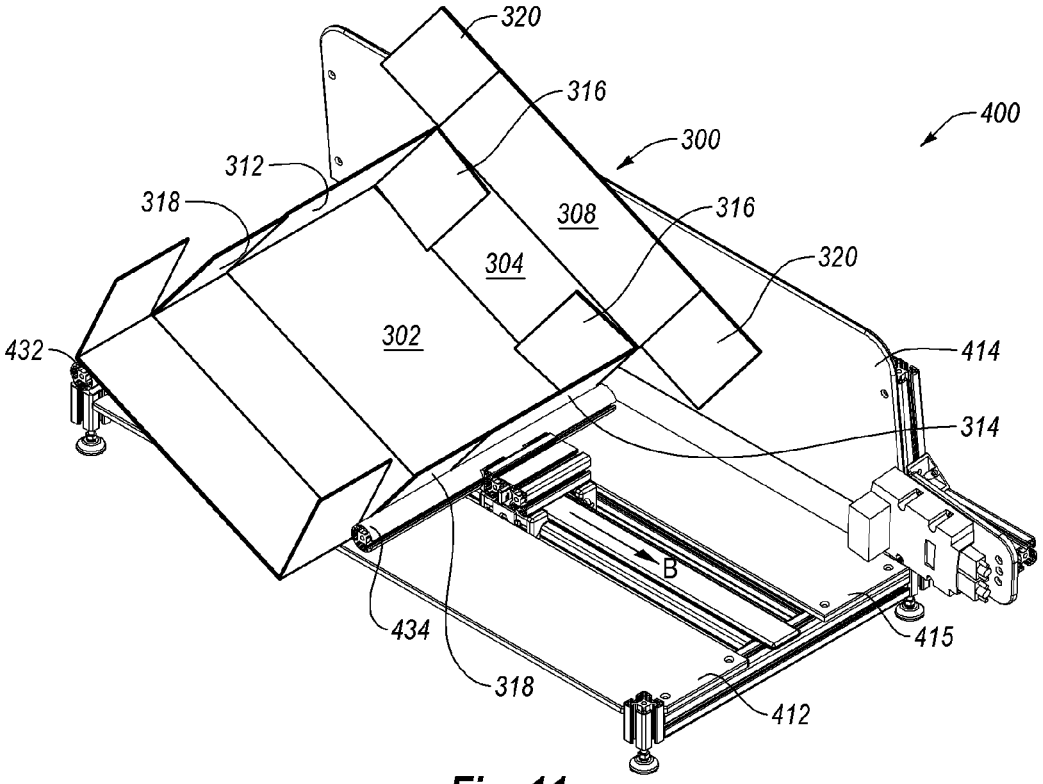

FIG. 11 illustrates a first set of steps in a method for erecting a box using an erecting aid 400. In the illustrated embodiment, box template 300 is partially erected and placed relative to erecting aid 400. More particular, in the illustrated embodiment, erecting aid 400 may have a clamp that includes a first clamp portion 432 and a second clamp portion 434. In this embodiment, second clamp portion 434 may be moved relative to a table surface 412. More particularly, second clamp portion 434 may be moved along arrow B, such that second clamp portion 434 is moved further from proximal end 413 and closer to distal end 415.

The distance which second clamp portion 434 is moved may vary based on the design of erecting aid 400, the size of box template 300, and the like. In this embodiment, second clamp portion 434 is moved to a location at which the distance between first and second clamp portions 432, 434 is approximately equal to a length of bottom panel 302 of box template 300. Box template 300 may also be used to assist in moving second clamp portion 434. For instance, in this embodiment, side panels 312, 314 and front flaps 318 of box template 300 are folded upward relative to bottom panel 302, to be generally perpendicular relative to bottom panel 302. Rear flaps 316 may also be folded upward relative to bottom panel 302, and may further be folded inward relative to side panels 312, 314, such that rear flaps 31 may be approximately perpendicular with respect to bottom panel 302 as well as side panels 312, 314. Rear panel 304, rear top panel 308, and rear top flaps 320 may also be folded upward in preparation for placement of box template adjacent table surface 412 and panel 414 of erecting aid 400.

Figure 12:
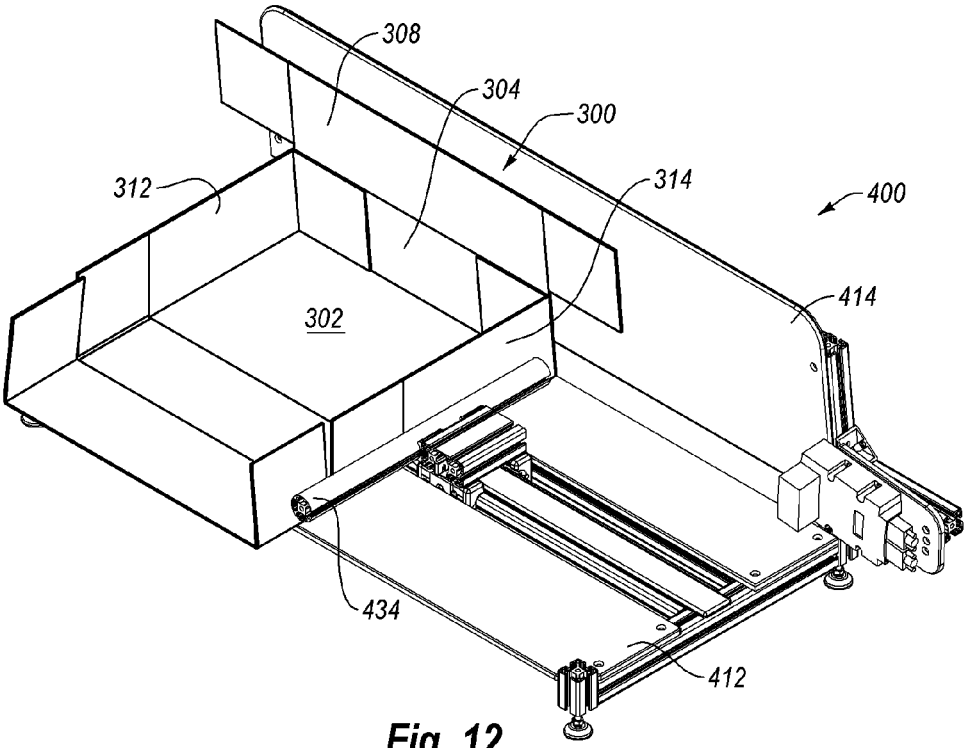

FIG. 12 illustrates another step in a process of assembling box template 300 into a box using erecting aid 400. In this embodiment, second clamp portion 434 has been separated from first clamp portion 432 by a distance that is approximately equal to the size of bottom panel 302 added to the material thickness of box template 300 for the thickness of side panels 312, 314. With such separation, bottom panel 302 of box template 302 has been placed on the table surface 412. Rear panel 304 and rear top panel 308 have also been folded upward relative to bottom panel 302, such that rear panel 304 and rear top panel 308 are generally perpendicular to bottom panel 302 of box template 300. As such, rear panel 304 and rear top panel 308 have been positioned against panel 414 of erecting aid 400. Side panels 312, 314, front flaps 318, and front top flaps 322 have also, in this embodiment, been folded to be approximately perpendicular to bottom panel 302, such that each has been placed against a corresponding one of first or second clamp portions 432, 434.

First and second clamp portions 432, 434 may exert a clamping force on box template 300 when partially erected as reflected in FIG. 12. For instance, moving second clamp portion 434 to the illustrated position may have placed a biasing or resistance mechanism in a stressed state. The stress on the resistance mechanism may be translated to first and second clamp portions 432, 434. More particularly, clamp portions 432, 434 may apply a compressive force to the partially erected box template 300 in FIG. 12. Box template 300 may, in turn, exert equal and opposite forces on first and second clamp portions 432, 434. As a result, the clamping force of first and second clamp portions 432, 434 is offset and erecting aid 400 maintains box template 300 in the partially erected configuration shown in FIG. 12, even in the absence of an operator holding on to any portion of box template 300.

While the description herein describes folding various panels and flaps in a manner such that they are generally perpendicular to other components, it should be appreciated that this is exemplary only, and that the precise angle may vary. For instance, as noted previously with regard to other embodiments, panel 414 may be positioned at an acute, right, or obtuse angle relative to table surface 412. Where panel 414 is at an acute or obtuse angle relative to table surface 412, rear panel 304 and/or rear top panel 308 may thus also be at a corresponding acute or obtuse angle relative to bottom panel 302.

Furthermore, the position and configuration of first and second clamp portions 432, 434 may be such that the clamping force causes one or more of panels 312, 314, or flaps 316, 318, 322 to bend inward such that the angle with bottom panel 302 is less than ninety degrees. For instance, as the clearance between table surface 412 and first and second clamp portions 434 increases, the clamping force may tend to press panels 312, 314, and/or flaps 316, 318, 322 inward. The description of folding panels and flaps in a manner such that they are about perpendicular is intended to incorporate such minor variations, particularly including variations of about fifteen degrees from perpendicular.

Figure 13:
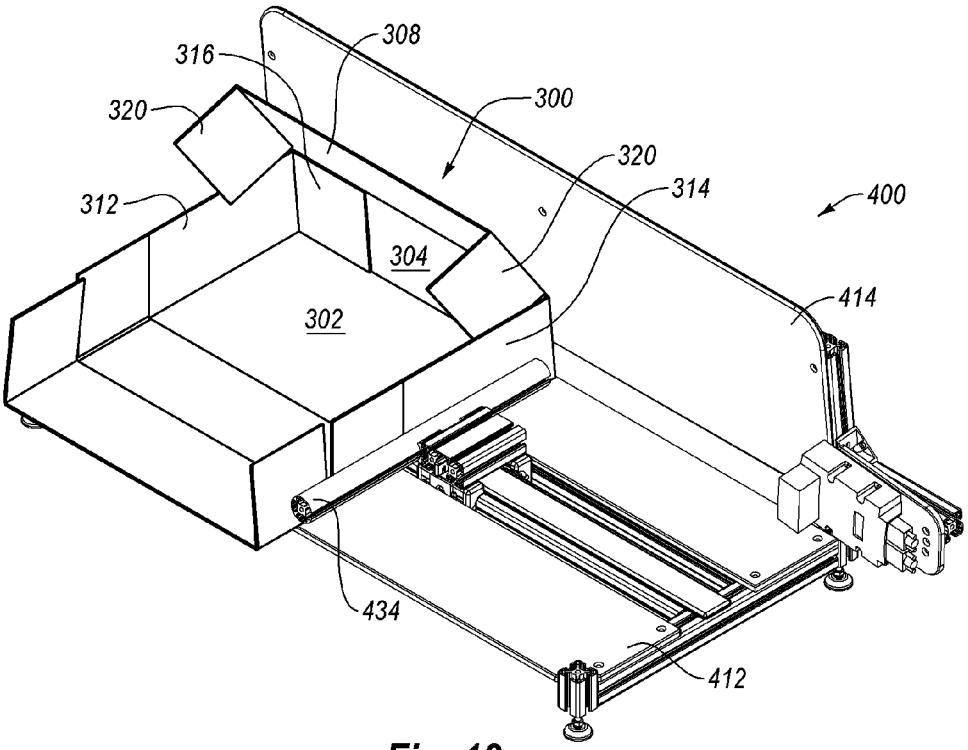

Turning now to FIG. 13, another step in a method of erecting a box from box template 300 using erecting aid 400 is illustrated. As compared to the partial assembly of box template as shown in FIG. 12, one or more additional steps have been made in FIG. 13 to assemble box template 300. In particular, box template 300 in the illustrated embodiment has been folded along at least three additional edges. For instance, rear top panel 308 has been folded generally downward relative to rear panel 304. In this case, rear top panel 308 has been folded about thirty degrees. As rear top panel 308 is attached, in this case, to rear top flaps 320, the folding of rear top panel 308 also folds rear top flaps 320 a corresponding amount relative to rear panel 304. Rear top flaps 320 may also be folded inward relative to rear top panel 308. In the illustrated embodiment, rear top flaps 320 have been folded to be generally perpendicular to rear top panel 308, and positioned inside of box template 300 relative to side panels 312, 314.

By virtue of a clamping force exerted by first and second clamp portions 432, 434, box template 300 may be maintained in the position illustrated in FIG. 13, even in the absence of an operator holding panels or flaps in place. Furthermore, as rear top panel 320 has been folded downward relative to rear panel 304, rear top flaps 320 may be positioned inside of side panels 316, such that the clamping force from clamp portions 432, 434 maintains rear top flaps 320 on the interior of box template 300. In some embodiments, an acute angle may be formed between panel 414 and table surface 412. In such cases, the acute angle may further act to facilitate pressing rear top flaps 320 downward and into the interior of partially assembled box template 300, so as to maintain box template 300 in the partially assembled state even in the absence of operator intervention.

Figure 14:
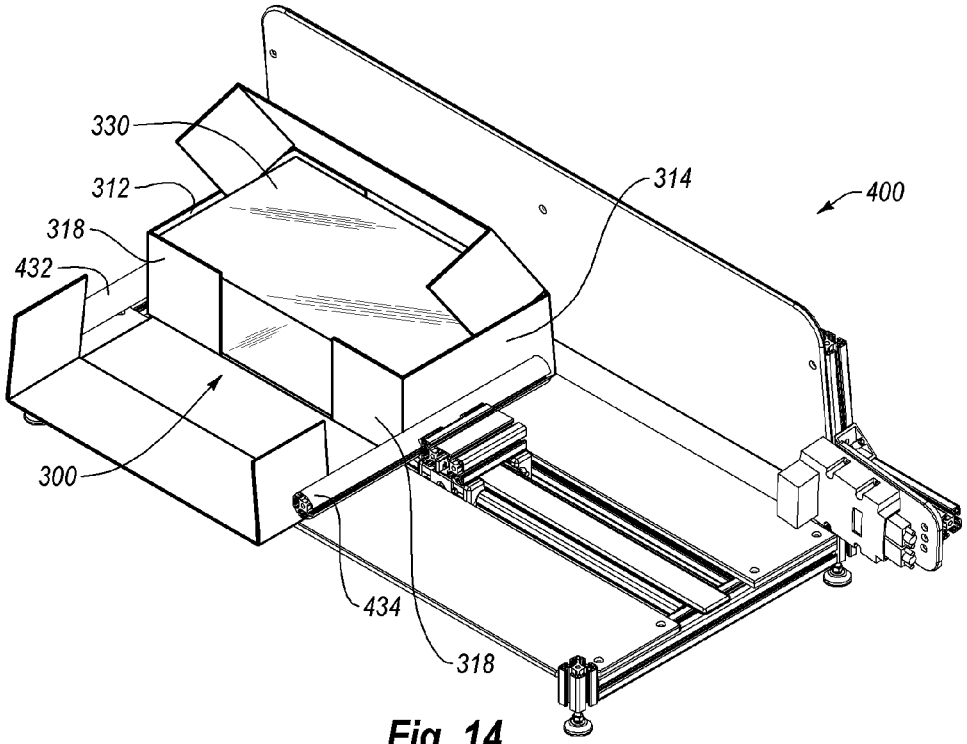

FIG. 14 illustrates another exemplary step in the example method of erecting a box from box template 300 using erecting aid 400. When compared with FIG. 13, an object 330 has been inserted into box template 300 and positioned against bottom panel 302, rear panel 304, and rear flaps 316. In addition, front flaps 318 have been folded inward relative to side panels 312, 314. In this embodiment, front flaps 318 have been folded to be about perpendicular to side panels 312, 314, thereby forming an enclosure for object 330. The continued clamping force from first and second clamp portions 432, 434 may then maintain box template 300 in this illustrated partially erected state, even in the absence of additional support from an operator.

Object 330 may be any type of suitable object. In the illustrated embodiment, object 330 is shown to have a generally rectangular construction; however, object 330 may be of any other type. For instance, object 330 may be a collection of different objects that together are contained within an assembled box template 300. In other embodiments, box template 300 may be erected without placing any object 330 therein.

While the insertion of object 330 is herein illustrated as occurring following the steps of FIG. 13, this is exemplary only. It will be appreciated that object 330 may be inserted, and the other steps of FIG. 14 performed, prior to the steps in FIG. 13. For instance, object 330 may be inserted or front flaps 318 folded inward before rear top panel 308 and rear top flaps 320 are folded relative to rear panel 304.

Figure 15:
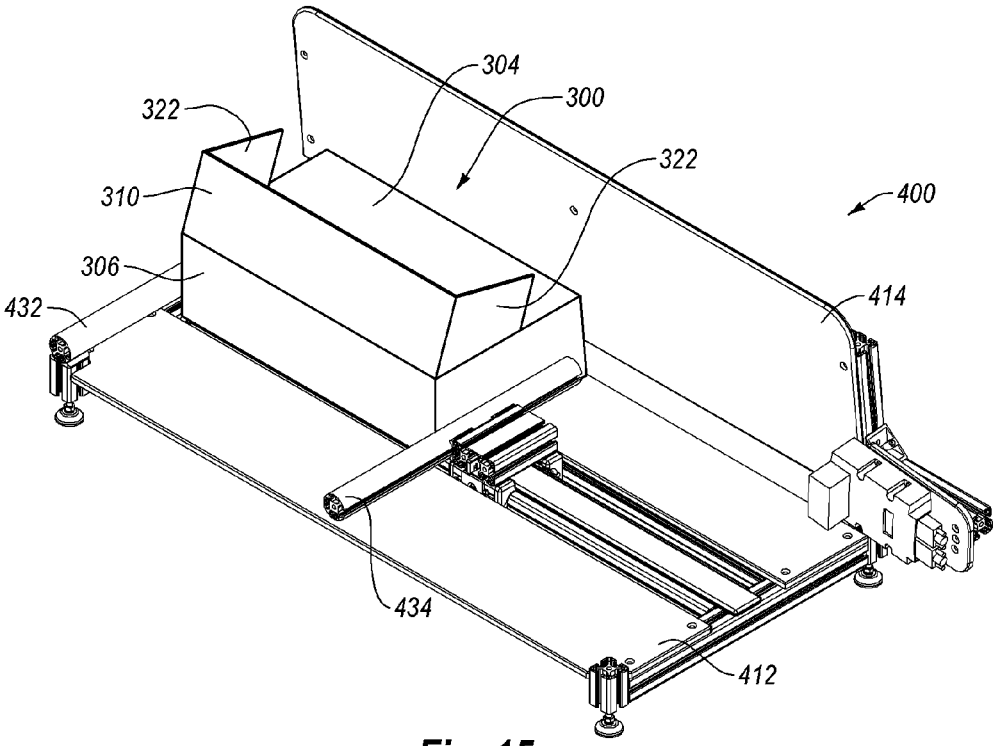

From the position in FIG. 14, assembly of box template 300 may continue using erecting aid 400. For instance, front panel 306 may be folded off of table surface 414, and positioned about perpendicular to bottom panel 302, as shown in FIG. 15. Front top panel 310 may be attached to front panel 306 and thereby may be moved in a corresponding manner. Once front panel 306 is positioned about perpendicular to bottom panel 302, front top panel 310 and front top flaps 322 may be folded downward relative to front panel 306. As shown in FIG. 15, for instance, front top flaps 322 have been positioned interior to side panels 312, 314 and front top panel 310 and front top flaps 322 have been rotated about thirty degrees relative to front panel. In this position, first and second clamp members 432, 434 may maintain box template 300 in the illustrated partially assembled state.

Figure 16:
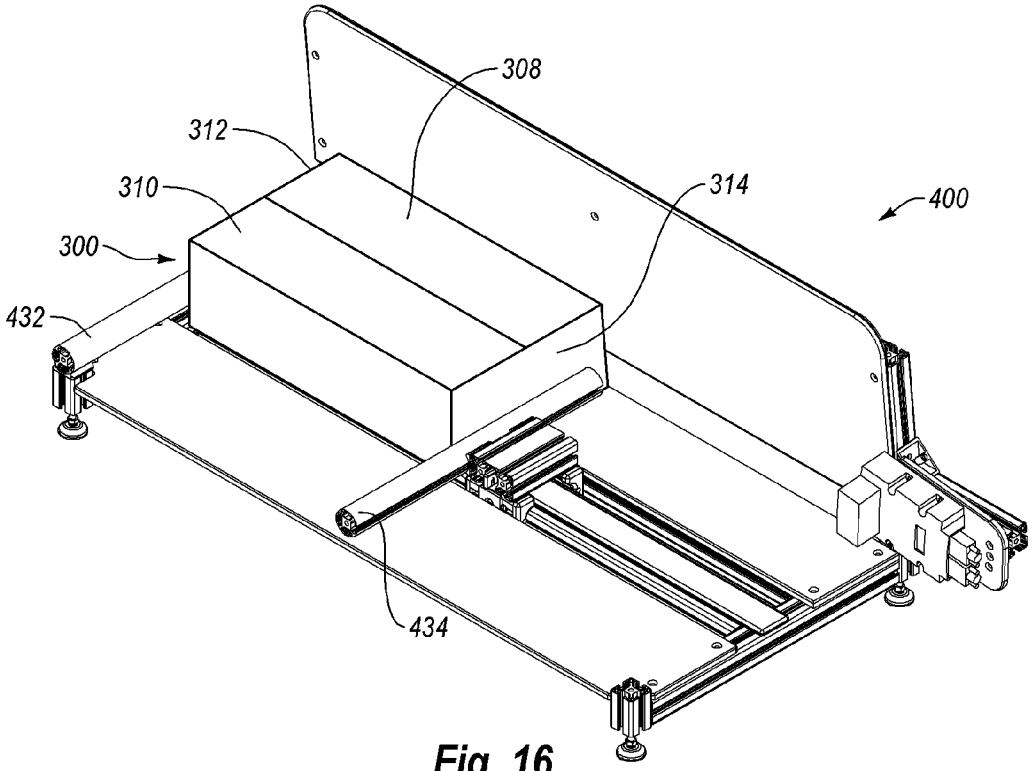
Figure 17:
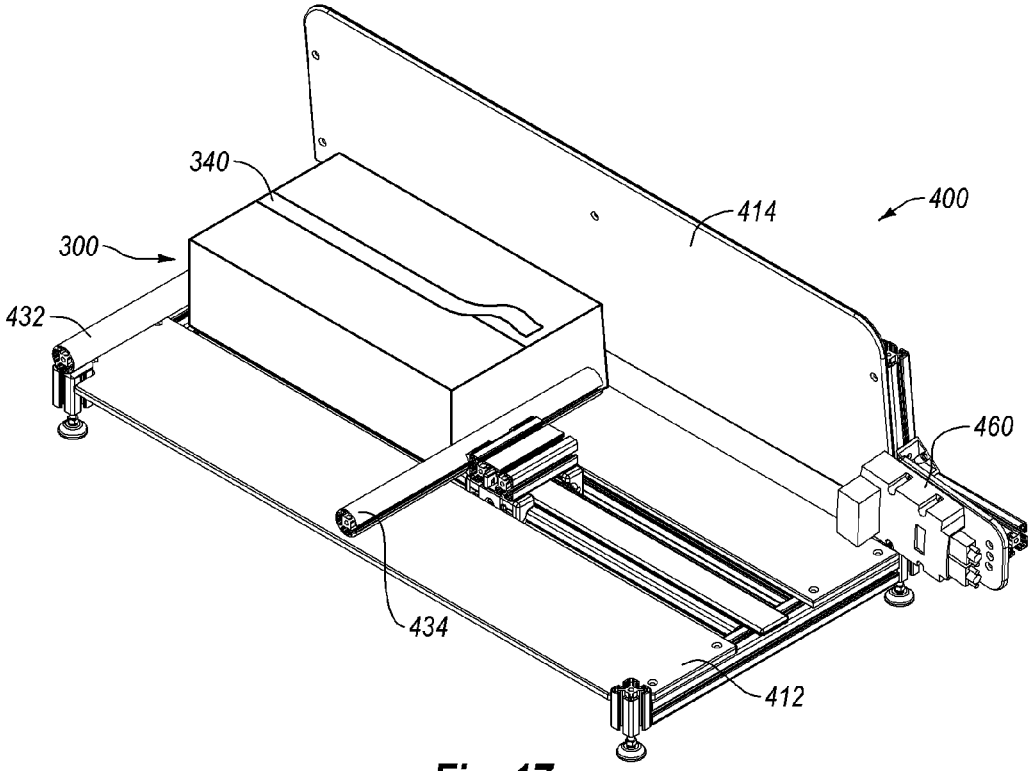

By continuing to fold front top panel 310 and front top flaps 322 downward, box template 300 may be erected and formed as shown in FIG. 16. More specifically, in the illustrated embodiment front top panel 310 has been folded to a position that is generally parallel to rear top panel 308 and about perpendicular to side panels 312, 314, and front panel 306. As shown in FIG. 16, when box template 300 is folded in the illustrated manner, a generally rectangular box may be formed with front top panel 310 and rear top panel 308 collectively forming the top of the box.

Upon folding box template 300 in the described or illustrated manner, assembled box template 300 may be removed from erecting aid 400. For example, an operator may exert a distally directed force on second clamp portion 434 to create some additional space between first and second clamp portions 432, 434. The additional space may release the clamping force from box template 300, and allow the operator to remove box template 300 from erecting aid 400. Once box template 300 is removed from erecting aid 400, second clamp member 434 may return to an initial position. In some embodiments, second clamp member 434 is biased to automatically move in a proximal direction back to an unstressed position. In other embodiments, a release mechanism may be depressed before second clamp member 434 may return to such a position.

Upon removing box template 300, box template 300 may be sealed in an appropriate manner. For instance, and operator may attach tape or another adhesive on a seam between front top panel 310 and rear top panel 308, thereby preserving box template 300 in its assembled form. An operator may instead position box template within a taping or gluing machine that then performs a sealing operation. Tape 340 may also be applied to box 300 while box 300 is still positioned on erecting aid 400, although this is not necessary. In some embodiments, as previously described, a sensor 460 or other indicator may be used in connection with erecting aid 400 to automatically determine a size of assembled box template 300 so that an amount of tape 340 is automatically and accurately determined, applied, and/or dispensed.

The particular manner in which sensor 460 operates can be varied according to any particular application. For instance, in some applications, sensor 460 may be a proximity or positional sensor that identifies a position of a movable member such as second clamp member 434. The position of movable clamp member 434 may be used to identify the distance that movable clamp member 434 has moved along table surface 412, so that a calculation of the size of box template 300 can be performed. That distance may then be communicated to a tape dispensing or applying mechanism that processes the information and dispenses and/or applies a properly sized piece of taping for the closed box template 300.

Other types of positional sensors or measurement devices may also be used. For instance, a sensor may identify the position of the distal end of box template 300, and use that positional information to calculate the size of box template 300. An overhead camera or measurement device may alternatively or additionally be used. In still another embodiment, a box may be assembled in an alternative matter where the seam between panels runs perpendicular to panel 414, and another measurement device may be used. So as to allow erecting aid 400 to be used with multiple sizes and configurations of box templates, some embodiments contemplate using multiple sensors to allow automated dispensing of tape. Where a sensor or multiple sensors are used, a trigger may also be included. That trigger, when selected by an operator, may cause the measurement to be sent to an automated tape dispenser. Sensing devices, triggers, and the like may be visible to the operator, or may be placed in other locations (e.g., under erecting aid 400) so as to be protected from damage.

Sensor 460 may also be used to perform tasks other than proximity or distance calculations. In some embodiments, sensor 460 or other measurement or sensing devices may be used to detect and/or measure other aspects of assembled box template 300. For instance, such sensor 460 may be used to identify the length, height, and width of box template 300, and may measure the weight of box template 300 either with or without any enclosed contents. In such a case, sensor 460 may communicate directly with a taping mechanism or other mechanism that may, for instance, print or otherwise dispense or apply a shipping label to box template 300. The taping mechanism or other print label dispenser may, for instance, calculate appropriate shipping costs using the dimensions and/or weight of box template 300, and may also account for the shipping destination, which may be entered via a user interface, or automatically provided as part of a box production and assembly system. For instance, a converter machine that produces box template 300 may receive information about the contents and/or destination of box template 300. The converter machine may be able to calculate the weight and dimensions of the box and possibly provide the weight, dimensions, and/or destination to a packaging label dispenser.

Furthermore, erecting aid 400 may include other features. For instance, shelves, bins, and/or storage compartments that may be coupled to or otherwise supported by erecting aid 400. Such shelves, bins, and other storage compartments may be used to store and/or support tape, labels, tape/label dispensers, printers and/or other equipment and tools regularly used in erecting and preparing a box for shipment.

The present invention may be embodied in other specific forms without departing from its spirit or essential characteristics. The described embodiments are to be considered, in all respects, illustrative only and not restrictive. The scope of the invention is, therefore, indicated by the appended claims rather than by the foregoing description. All changes which come within the meaning and range of equivalency of the claims are to be embraced within their scope.

We claim:

1. An erecting aid for erecting a box from a box template, comprising:

a planar table having a length extending between a proximal end and a distal end thereof and having an upper surface upon which a box template may be positioned;

a panel coupled to a side of said planar table at least partially between said proximal end and said distal end of said planar table, said panel having a proximal end, a distal end, a top edge, and a bottom edge, said panel extending upwardly relative to said upper surface of said planar table, said bottom edge of said panel being positioned closer to said upper surface than said top edge of said panel, said panel comprising a planar surface extending between said proximal end, said distal end, said top edge, and said bottom edge of said panel, said bottom edge of said panel being pivotally connected to said planar table such that an angle formed between said panel and said planar table is selectively adjustable such that an extent to which said top edge of said panel extends over said upper surface of said planar table is selectively adjustable; and a clamp operatively associated with said planar table, said clamp comprising:

a first clamp portion, said first clamp portion being secured in a fixed and stationary position relative to said planar table and extending upwardly relative to said upper surface of said planar table such that said first clamp portion can engage a box template positioned on said upper surface of said planar table; and a second clamp portion, said second clamp portion being movable along at least a portion of said length of said planar table between said proximal end and said distal end of said planar table and relative to said panel, said second clamp portion being continuously biased towards said first clamp portion in a manner that creates a clamping force between said first clamp portion and said second clamp portion;

wherein said planar table, said panel, and said clamp are configured to stabilize and maintain a box template in a partially assembled state during an erecting process that occurs on said planar table.

2. The erecting aid recited in claim 1, wherein said panel is coupled to said side of said planar table such that said panel and said planar table form an acute angle.

3. The erecting aid recited in claim 2, wherein said acute angle is in a range of between about 80 and about 87 degrees.

4. The erecting aid recited in claim 1, further comprising one or more adjustable panel supports, wherein said adjustable panel supports enable the angle between said panel and said planar table to be selectively adjusted.

5. The erecting aid recited in claim 1, wherein said second clamp portion is movable along said at least a portion of said length of said planar table in a direction parallel to a major surface of said panel.

6. The erecting aid recited in claim 1, further comprising a track, said second clamp portion being configured to move at least partially along said track, whereby said track guides the movement of said second clamp portion along said at least a portion of said length of said planar table.

7. The erecting aid recited in claim 1, wherein said second clamp portion is continuously biased by a spring loaded biasing mechanism.

8. The erecting aid recited in claim 6, wherein said track is disposed below said upper surface of said planar table.

9. A corrugated box erecting aid, comprising:

a table having a length extending between a first end and a second end and having an upper surface upon which a partially folded corrugated box may be positioned;

a panel adjustably coupled to a side of said table, wherein said panel extends upwardly relative to said upper surface of said table such that said panel and said upper surface of said table form an acute angle, said panel having a proximal end, a distal end, a top edge, and a bottom edge, said bottom edge being disposed adjacent to said table and said top edge being disposed further from said upper surface than said bottom edge, said panel comprising a planar surface extending between said proximal end, said distal end, said top edge, and said bottom edge of said panel;

a track cooperating with said table and having a length extending along at least a portion of said length of said table between said first end and said second end; and a clamp operatively associated with said track, said clamp comprising:

a stationary first clamp portion secured in a stationary position adjacent said first end of said table, said stationary first clamp portion extending upwardly relative to said upper surface of said table such that said stationary first clamp portion can engage a partially folded corrugated box positioned on said upper surface of said table;

a movable second clamp portion, said movable second clamp portion being biased towards said first end of said table and being selectively movable along said track towards said second end of said table, said movable second clamp portion being movable relative to and in a direction generally parallel to said panel, wherein said movable second clamp portion moves toward said second end of said table and away from said stationary first clamp portion as a partially folded corrugated box is inserted between said stationary first clamp portion and said movable second clamp portion; and one or more clearance zones between said stationary first clamp portion and said table and between said movable second clamp portion and said table, wherein said movable second clamp portion, said stationary first clamp portion, said table, and said panel are configured to collectively hold in place folded portions of a partially folded corrugated box.

10. The corrugated box erecting aid as recited in claim 9, wherein said one or more clearance zones permit said stationary first clamp portion and said movable second clamp portion to compress two opposing side corrugated panels of said partially folded corrugated box such that said two opposing side corrugated panels hold a third corrugated portion in a folded position.

11. The corrugated box erecting aid as recited in claim 9, wherein said movable second clamp portion further comprises a carriage, wherein said carriage interfaces with said track such that said movable second clamp is selectively movable along said track.

12. The corrugated box erecting aid as recited in claim 9, further comprising a biasing mechanism that biases said movable second clamp portion toward said first end of said table, said biasing mechanism being operatively connected between said movable second clamp portion and a frame supporting said table.

13. The corrugated box erecting aid as recited in claim 12, wherein said biasing mechanism is a spring or spring loaded device.

14. The corrugated box erecting aid as recited in claim 9, wherein said acute angle is within a range of 75 degrees to less than 90 degrees.

15. The corrugated box erecting aid as recited in claim 9, wherein said table, panel, track, and clamp collectively operate to enable assembly of a FEFCO 416, FEFCO 412 or RSC style box.

16. The corrugated box erecting aid recited in claim 9, wherein said table, panel, track and clamp are configured for arrangement into a first setup arrangement, wherein the first setup arrangement facilitates assembly of a plurality of different styles and sizes of boxes.

17. A method of erecting a corrugated box, comprising:

providing an erecting aid comprising:

a generally planar table surface, a panel disposed along and extending upwardly relative to an operative portion of said generally planar table surface, the panel having a proximal end, a distal end, a top edge, and a bottom edge, the bottom edge being disposed adjacent to the generally planar table surface and the top edge being disposed further from the generally planar table surface than the bottom edge, the panel comprising a planar surface extending between the proximal end, the distal end, the top edge, and the bottom edge of the panel, and a clamp comprising a stationary clamp portion and a movable clamp portion, the movable clamp portion being continuously biased toward said stationary clamp portion and movable relative to said generally planar table surface and said panel, said stationary clamp portion extending upwardly relative to said generally planar table surface;

receiving a corrugated box template;

making initial folds in said corrugated box template to form a partially folded corrugated box template;

after making said initial folds, placing said partially folded corrugated box template in the erecting aid, wherein placing said partially folded corrugated box template in the erecting aid comprises:

inserting said partially folded corrugated box template between and in contact with said stationary clamp portion and said movable clamp portion such that said movable clamp portion is moved away from said stationary clamp portion and the biasing of said movable clamp portion toward said stationary clamp portion exerts a clamping force on said partially folded corrugated box template;

supporting said partially folded corrugated box template on said generally planar table surface; and positioning at least a portion of said partially folded corrugated box template against said panel;

stabilizing folded regions of said partially folded corrugated box template, such that said partially folded corrugated box template remains in its partially folded state; and performing additional folds to completely erect the corrugated box from said corrugated box template.

18. The method of erecting a corrugated box as recited in claim 17, wherein:

stabilizing folded regions of said partially folded corrugated box template comprises inserting one or more objects into said partially folded corrugated box template prior to performing said additional folds to completely erect the corrugated box; or performing said additional folds to completely erect the corrugated box includes performing said additional folds without inserting an object into an interior of the corrugated box.

19. A method of erecting a corrugated box as recited in claim 17, wherein:

said received corrugated box template is a FEFCO 416 box; and making initial folds in said corrugated box template to form a partially folded corrugated box is performed prior to placing said partially folded corrugated box template in said erecting aid, and wherein making said initial folds comprises:

folding one or more side panels, front flaps and rear panels to be about perpendicular to a bottom panel; and folding one or more rear flaps to be about perpendicular to said bottom panel and said one or more side panels.

20. The method of erecting a corrugated box as recited in claim 17, further comprising:

inserting one or more objects into said partially folded corrugated box template prior to performing said additional folds to completely erect the corrugated box; and sealing the corrugated box after performing said additional folds to completely erect the corrugated box.

21. The method of erecting a corrugated box as recited in claim 17, wherein one or more clearance zones are disposed between said stationary clamp portion and said generally planar table surface and between said movable clamp portion and said generally planar table surface.

22. The method of erecting a corrugated box as recited in claim 17, further comprising orienting said panel at an acute angle relative to said generally planar table surface.

23. An erecting aid for erecting a box from a box template, comprising:

a planar table having a length extending between a proximal end and a distal end thereof and having an upper surface upon which a box template may be positioned;

a panel coupled to a side of said planar table at least partially between said proximal end and said distal end of said planar table, said panel extending upwardly relative to said upper surface of said planar table, a bottom edge of said panel being disposed adjacent to said planar table and a top edge of said panel being disposed further from said planar table than said bottom edge; and a clamp operatively associated with said planar table, said clamp comprising:

a first clamp portion, said first clamp portion being secured in a fixed and stationary position relative to said planar table and extending upwardly relative to said upper surface of said planar table such that said first clamp portion can engage a box template positioned on said upper surface of said planar table;

a second clamp portion, said second clamp portion being movable along at least a portion of said length of said planar table between said proximal end and said distal end of said planar table and relative to said panel, said second clamp portion being continuously biased towards said first clamp portion in a manner that creates a clamping force between said first clamp portion and said second clamp portion; and one or more clearance zones between said first clamp portion and said upper surface of said planar table and between said second clamp portion and said upper surface of said planar table, wherein said one or more clearance zones permit said first clamp portion and said second clamp portion to compress two opposing side panels of said box template such that said two opposing side panels hold a third portion of said box template in a folded position;

wherein said planar table, said panel, and said clamp are configured to stabilize and maintain said box template in a partially assembled state during an erecting process that occurs on said planar table.

* * * * *